United States Patent [19]

Hara et al.

[11] Patent Number: 4,487,663

[45] Date of Patent: Dec. 11, 1984

[54] STEEL SHEETS FOR PREPARING WELDED AND COATED CANS AND METHOD FOR MANUFACTURING THE SAME

[75] Inventors: Tomihiro Hara, Yokohama; Hiroshi Kagechika, Kawasaki; Satoshi Doi, Yokohama; Yoshinori Yomura, Kawasaki, all of Japan

[73] Assignee: Nippon Kokan Kabushiki Kaisha, Tokyo, Japan

[21] Appl. No.: 483,673

[22] Filed: Apr. 11, 1983

Related U.S. Application Data

[63] Continuation-in-part of Ser. No. 195,523, Oct. 9, 1980, abandoned.

[30] Foreign Application Priority Data

Nov. 22, 1979 [JP] Japan ..... 54-150579

[51] Int. Cl.[3] ..... C25D 5/50; C25D 9/10

[52] U.S. Cl. ..... 204/27; 204/373; 204/40; 204/56 R

[58] Field of Search ..... 204/27, 28, 37 T, 38 R, 204/38 B, 40, 41, 56 R; 428/629, 632, 633, 648

[56] References Cited

U.S. PATENT DOCUMENTS

| | | | |
|---|---|---|---|
| 2,245,561 | 6/1941 | Nelson et al. | 220/64 |
| 2,327,127 | 8/1943 | Rath | 148/6 |
| 3,160,481 | 12/1964 | Shoemaker | 29/195 |
| 3,174,917 | 3/1965 | Lesney et al. | 204/37 |
| 3,491,001 | 1/1970 | Shackleford et al. | 204/56 |
| 3,532,608 | 10/1970 | Serra | 204/28 |
| 3,772,165 | 11/1973 | Yamagishi | 204/28 |
| 4,015,950 | 4/1977 | Galland et al. | 428/648 |
| 4,113,580 | 12/1978 | Tsutsui et al. | 204/37 T |
| 4,282,981 | 11/1981 | Kitamura et al. | 220/75 |

FOREIGN PATENT DOCUMENTS

| | | |
|---|---|---|
| 674490 | 6/1952 | United Kingdom . |
| 925065 | 5/1963 | United Kingdom . |
| 984991 | 3/1965 | United Kingdom . |
| 1038171 | 8/1966 | United Kingdom . |
| 1436661 | 5/1976 | United Kingdom . |

OTHER PUBLICATIONS

Kubaschewski, O. et al.; *Oxidation of Metals and Alloys*, 2nd Edition, Academic Press Inc., London, 1962, p. 1.

*Primary Examiner*—G. L. Kaplan
*Assistant Examiner*—William T. Leader
*Attorney, Agent, or Firm*—Frishauf, Holtz, Goodman & Woodward

[57] ABSTRACT

A steel sheet utilized to prepare cans comprises an iron base sheet, a Fe—Sn alloy layer formed on the iron base sheet and containing 0.05–0.7 g/m$^2$ of tin and 40–80 atomic % of iron, and a composite oxide film formed on the alloy layer and containing Fe, Sn, Cr and O. The composite oxide film is formed by applying a cathodic dichromate treatment to the steel sheet which has been quenched and cooled to form an oxide film on the alloy layer, the oxide film containing both of tin and iron oxides being converted to the composite oxide film.

7 Claims, 8 Drawing Figures

STEEL SHEETS FOR PREPARING WELDED AND COATED CANS AND METHOD FOR MANUFACTURING THE SAME

CROSS-REFERENCE TO RELATED APPLICATION

This application is a continuation-in-part of our copending application Ser. No. 195,523, filed on Oct. 9, 1980, now abandoned.

BRIEF SUMMARY OF THE INVENTION

This invention relates to steel sheets utilized to prepare welded and coated cans and method for manufacturing the same.

Soldered cans have been generally used for containing foodstuffs but it is a recent trend to substitute welded and coated cans and bonded cans for the soldered cans. Furthermore, thickly plated tinned plate cans without inner coatings are now being substituted by thinly plated tinned plate cans with inner coatings or tin free steel (TFS) cans. Under these circumstances, requirements for the blanks used to prepare cans have been substantially changed. Thus, where the inner coatings are used, the lacquer adhesion of the coatings and the anticorrosion property after coating are most important. The tin free steel sheet is a surface treated sheet manifesting an excellent lacquer adhesion to the applied coating and is widely used for bonded cans but its corrosion resistance after coating is poor and its weldability is also extremely poor. For these reasons, the tin free steel sheet can not be used for welded cans, for example spray cans required to have a strong bonding force. For this reason, it has been desired to develop an excellent blank suitable for manufacturing cans having lacquer adhesion comparable with that of the tin free steel sheet yet having an excellent corrosion resistance and weldability. In spite of various efforts, satisfactory can making blank sheet is not yet available.

Accordingly, it is an object of this invention to provide an improved steel sheet for preparing welded and coated cans, the steel sheet being characterized by having excellent weldability, high lacquer adhesion to the applied coatings and high corrosion resistance after being coated with a coating.

According to one aspect of this invention there is provided a steel sheet for preparing welded and coated cans comprising a steel sheet substrate, a Fe—Sn alloy layer coated on the substrate and containing 0.05–0.7 $g/m^2$ of tin, the alloy layer containing iron in an atomic percentage of 40–80%, and a composite oxide film formed on the alloy layer by cathodic dichromate treatment and containing Fe, Sn, Cr and O, the quantities of Fe and Cr in the composite oxide film being 1–5 $mg/m^2$ and 2–10 $mg/m^2$, respectively.

According to another aspect of the invention there is provided a method for manufacturing steel sheets for welded and coated cans comprising the steps of preparing a steel sheet substrate, depositing on the substrate 0.05–0.7 $g/m^2$ of tin, heating in a reducing atmosphere the substrate covered with the tin layer for a time and to a temperature sufficient to form a Fe—Sn alloy layer whose iron content is 40–80 atomic percentage, all of the tin of the tin layer having been alloyed with iron of the substrate to form the Fe—Sn alloy layer, quenching and cooling the substrate covered with the Fe—Sn alloy layer in such manner that an oxide film containing both of iron and tin oxides is formed on the Fe—Sn alloy layer, and subjecting the resulting sheet to a cathodic dichromate treatment and thereby converting the oxide film to a composite oxide film containing Fe, Sn, Cr and O, the quantities of Fe and Cr in the composite oxide film being 1–5 $mg/m^2$ and 2–10 $mg/m^2$, respectively.

BRIEF DESCRIPTION OF THE DRAWINGS

Further objects and advantages of the invention will be more fully understood from the following detailed description when read in conjunction with the accompanying drawings in which.

DESCRIPTION OF THE PREFERRED EMBODIMENTS

We have succeeded in preparing steel sheets suitable for manufacturing cans by using only iron and tin as metals for preparing the steel sheets and by perfectly alloying the surface layer of the steel sheet to form a surface composition that forms an oxide film manifesting excellent lacquer adhesion. The resulting alloy layer has a fine crystalline structure, that is amorphous which is necessary to improve the workability. In addition, a surface layer is formed having a composition which acts cathodically with respect to the iron base and has a large cathodic polarization, thus obviating the disadvantages described above.

Our research regarding Fe—Sn alloy has revealed the following facts.

(1) A $FeSn_2$ alloy has a crystal columnar structure and a high porosity so that working cracks tend to be formed.

(2) A Sn rich oxide film is formed on Sn layer or $FeSn_2$ alloy layer, the oxide film having a low lacquer adhesion.

(3) When a thin Sn layer is plated on an iron base and then heat treated an alloy layer is formed having a higher Fe ratio than the $FeSn_2$ alloy. On the surface of the alloy having such a high atomic percentage of iron is formed an oxide film consisting of a mixture of iron and tin oxides and having an excellent lacquer adhesion.

(4) The surface alloy substantially comprising FeSn is of an amorphous structure having an excellent lacquer adhesion. The FeSn layer does not form cracks when being deformed.

(5) An alloy layer containing a high percentage of iron has a weldability comparable with that of iron, and can prevent heat oxidation at the time of welding and has a large cathodic polarization under a corrosive environment.

Figure 1:
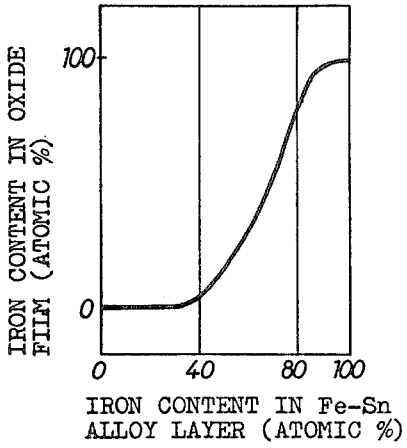
FIG. 1 is a graph showing the relationship between the iron content on Fe—Sn alloy layer and the iron content of oxide film formed on the surface of the Fe—Sn alloy layer.
Figure 2:
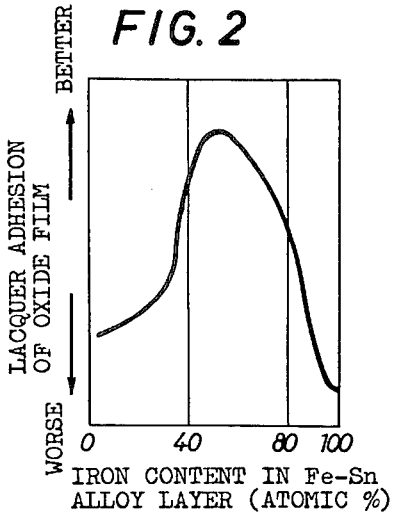
FIG. 2 is a graph showing the relationship between the iron content of Fe—Sn alloy layer and the lacquer adhesion of the oxide film.

More particularly, as shown by the graph shown in FIG. 1, the atomic percentage of iron in the oxide film varies depending on the atomic percentage of iron in the Fe—Sn alloy layer, and when the Fe—Sn alloy layer contains 40–80 atomic percentage of iron the oxide film formed thereon will contain both of iron and tin oxides. In this case, the adhesiveness of the oxide film varies as shown in FIG. 2. Thus, the adhesiveness of the oxide film can be greatly improved in a range of 40 to 80% of the atomic percentage of iron in the Fe—Sn alloy layer showing greatly improved lacquer adhesion over the prior art $FeSn_2$ alloy in which the atomic percentage of iron is about 33%.

According to this invention a unique utilization of these characteristics is made wherein novel characteristics of an alloy layer containing iron at a high percentage are utilized to eliminate various difficulties of the prior art blank for manufacturing cans. Thus, it is possible to obtain surface treated steel sheets having higher weldability than the tin free steel sheet, excellent lacquer adhesion comparable with or higher than that of the tin free steel sheet and higher corrosion resistance against the coating than that of the tin free steel sheet.

Figure 3:
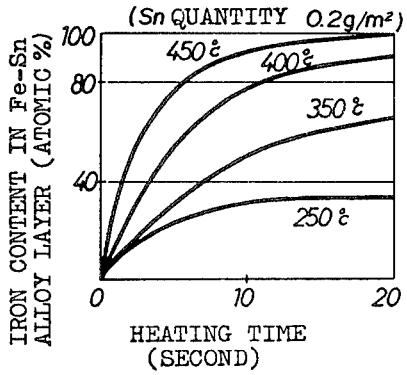
FIGS. 3, 4 and 5 are graphs showing the relationship between the heating time and the iron content of Fe—Sn alloy layer when the quantity of Sn is 0.2 $g/m^2$, 0.5 $g/m^2$ and 0.7 $g/m^2$ respectively.
Figure 4:
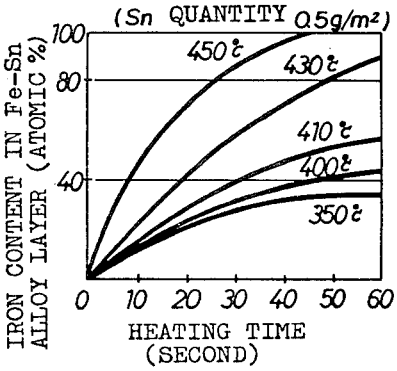
Figure 5:
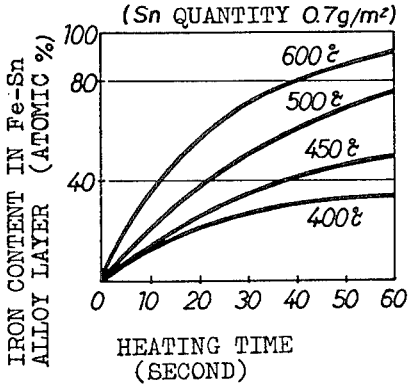

In order to form an alloy and to cause it to have the desired characteristics described above it is essential to uniformly deposit tin during a tin plating step prior to the alloying step. According to this invention 0.05–0.7 $g/m^2$ of tin is uniformly deposited to form a homogeneous alloy. More particularly, when the amount of the plated tin is less than 0.05 $g/m^2$, it is impossible to form a stable coating and a homogeneous alloy layer, thus failing to form a satisfactory oxide film containing both iron and tin oxides. Consequently, as will be described later, it is impossible to obtain satisfactory lacquer adhesion, weldability and corrosion resistance after plating. When the quantity of the plated tin exceeds 0.7 $g/m^2$, a large quantity of tin must be used which is not only uneconomical but also increases the heating temperature and time necessary for alloying. In addition, use of plated tin in an amount greater than 0.7 $g/m^2$ increases the thickness of the Fe—Sn alloy layer, thus forming cracks when the alloy layer is being deformed. A desired quantity of the plated tin may be obtained in the initial stage of conventional plating technique but in this invention it is important to form a relatively thin plated tin layer to assure a high density and homogeneity of an alloy layer obtained by alloying the plated layer so that it is desirable to improve plating technique prior to the alloying step over the prior art method. Thus, an alkaline electrolytic plating method and a method of utilizing an electrolytic bath consisting of $H_2SO_4$ and a nonionic activator are preferred. The heating of the tin plated sheet to obtain an alloy layer containing 40 to 80 atomic % of iron may be of continuous or batch type and heating time is determined suitably by taking into consideration the quantity of tin and the heating temperature. For example, where the quantity of tin is relatively small, that is 0.2 $g/m^2$, the relationship between the heating time and the atomic percentage of iron in the Fe—Sn alloy layer is shown in FIG. 3 in which the heating time is taken as the parameter. This relationship for a case wherein the quantity of tin is relatively large, for example 0.7 $g/m^2$, is shown in FIG. 5. Where the quantity of tin is 0.5 $g/m^2$ the relationship is shown in FIG. 4. In the case shown in FIG. 3, at a heating temperature of 250° C., even when the heating time is elongated it is impossible to form an alloy layer containing at least 40 atomic % of iron so that it is necessary to increase the heating temperature. With a heating temperature of 350° C., it is possible to form an alloy layer containing iron of not lower than 40 atomic % in more than 8 seconds, and at a temperature of 400° C. in more than 3.5 seconds, and in more than 1 second at 450° C. However, the atomic percentage of iron increases beyond 80% in more than 10 seconds at 400° C. and in more than 4 seconds at 450° C. In the case shown in FIG. 4, at a heating temperature of 350° C. it is impossible to form an alloy having an atomic % of iron of 40% or more even when the heating time is elongated so that it is necessary to increase the heating temperature. Thus, it is possible to form an alloy layer in which the iron content is 40 atomic % or more when heated for more than 50 seconds at a temperature of 400° C., for more than 32 seconds at 410° C., for more than 20 seconds at 430° C. and for more than 8 seconds at 450° C. In the case of the heating temperature of 480° C., an alloy layer having an atomic percentage of iron of higher than 80% is formed when heated for more than 48 seconds and to form an identical alloy layer by heating for more than 26 seconds at 450° C. In the case shown in FIG. 5, with the heating temperature of less than 400° C., as it is impossible to form an alloy layer having an atomic percentage of iron not lower than 40% even with longer heating time it is necessary to increase the heating temperature. Thus, it is possible to form an alloy layer having an atomic % of iron of 40% or more when the sheet is heated at a temperature of 450° C. for more than 38 seconds, at a temperature of 500° C. for more than 22 seconds and at a temperature of 600° C. for more than 11 seconds. However, the atomic percentage of iron exceeds 80% when heated at 600° C. for more than 40 seconds.

The oxide film formed on the Fe—Sn alloy layer containing 40 to 80 atomic % of iron will contain both of iron and tin oxides and show excellent lacquer adhesion and corrosion resistance, as shown in the following Tables I and II. More particularly, tin was electroplated on samples of steel base in a plating bath consisting of 60 g/l of $SnSO_4$, 20 g/l of $H_2SO_4$, 10 g/l of ethoxy $\alpha$ naphthol and a nonionic activating agent, at a current density of 50 $A/dm^2$ and at a temperature of 40° C., so that a Fe—Sn alloy layer is formed on the steel base. After electroplating tin in this manner, the steel sheet was heat treated in a gas mixture of 2–3% hydrogen and the reminder nitrogen, and then air-quenched followed by natural cooling in air, thereby forming an outermost layer of oxide film. The tin quantity and the heating condition were varied as shown in Table I. Samples 3–5, 8 and 9 were further subjected to a cathodic dichromate treatment in a bath consisting of 20 g/l of potassium dichromate and maintained at pH=5.7 and a temperature of 50° C., at a current density of 5 $A/dm^2$ for 3 seconds, so as to prepare the steel sheet according to the invention having a sectional configuration as shown in FIG. 7.

TABLE I

Figure 6:
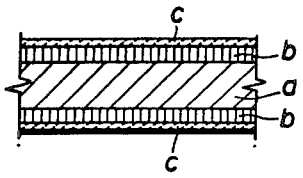
FIGS. 6, 7 and 8 are enlarged sectional views of steel sheets embodying the invention.
Figure 7:
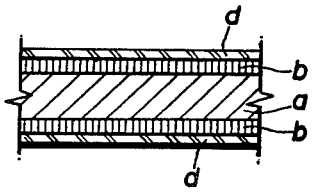

| sample | type | deposited tin quantity | heating condition | Fe content in Fe—Sn alloy layer |
|---|---|---|---|---|
| 1 | FIG. 6 | 0.2 $g/m^2$ | 450° C. | 50 atom. % |
| 2 | FIG. 6 | 0.4 | 450 | 45 |
| 3 | FIG. 7 | 0.3 | 400 | 60 |
| 4 | FIG. 7 | 0.3 | 450 | 63 |
| 5 | FIG. 7 | 0.7 | 500 | 45 |
| 6 | FIG. 6 | 0.3 | 250 | 35 |
| 7 | FIG. 6 | 0.2 | 450 | 90 |
| 8 | FIG. 7 | 1.0 | 350 | 30 |
| 9 | FIG. 7 | 0.01 | 250 | 38 |

The results of tests made on the lacquer adhesion, corrosion resistance, weldability of the samples shown in Table I are shown in the following Table II.

TABLE II

| | lacquer adhesion | | corrosion resistance | | | weldability | | | |
|---|---|---|---|---|---|---|---|---|---|
| | | circular | after painting | | without | | air | dust | oxidation |
| sample | $2^T$ bend | press | cross cut | Erichsen | painting | nugget | tightness | product | proofness |
| 1 | 25 | ◎ | o | ◎ | o | o | o | o | o |
| 2 | 50 | o | o | o | o | o | o | o | o |
| 3 | 33 | ◎ | ◎ | ◎ | ◎ | o | o | o | o |
| 4 | 29 | ◎ | ◎ | ◎ | ◎ | o | o | o | o |
| 5 | 75 | o | o | o | ◎ | o | o | o | o |
| 6 | 30 | x | x | x | o | o | o | o | x |
| 7 | 48 | x | x | x | x | x | x | x | o |
| 8 | 92 | x | o | x | o | o | o | x | x |
| 9 | 31 | x | x | x | x | x | x | x | x |

The method of tests and the references of judgement of Table II are as follows:

(1) Lacquer adhesion

After painting with 50 mg/dm$^2$ of an epoxide phenol type lacquer, the sample was baked at a temperature of 210° C. for 10 minutes, and the broken area at a portion bent in a $2^T$ bend test and the state of peel off by means of a self-adhesive tape at a portion shaped by a circular press were measured.

The measured value is a result of a $2^T$ bend test showing an exposed area percentage of the iron sheet. Symbol " ◎ " represents no peel off, "o" a little peel off and "x" a large peel off after shaped with a circular press.

(2) Corrosion resistance after painting

After plating in such manner as described in the test method (1), the degree of corrosion of a cross cut portion after immersing in a 0.1N citric acid solution at 35° C. for 48 hours, and the extent of peel off by means of a self-adhesive tape was observed after extruding by 5 mm with an Erichsen testing machine and then immersing in a 0.1N citric acid solution at 50° C. for 75 hours.

Regarding the results of test, symbol " ◎ " represents no peel off, "o" a little peel off and "x" a large peel off.

(3) Corrosion resistance without painting

In this test, the manner of forming red colored rust was measured after maintaining the sample in air having a relative humidity of more than 95%, at 50° C. for 24 hours, before plating. Symbol " ◎ " indicates that no rust could be confirmed with the naked eye, "o" scarcely confirmed and "x" the degree of red rust is large.

(4) Weldability

This property was determined by microscopic observation of the formation of nugget at a cross-section of a weld, the range of welding current necessary to maintain air tightness was measured by the Weld-Lob process, and the tendency of generating dust and the oxidizing property of a weld were measured. The symbol "o" indicates excellent weldability, "x" poor weldability.

As known from the results in Table II regarding the samples 1-2 and 6-7, excellent lacquer adhesion, corrosion resistance and weldability can be achieved when the Fe—Sn alloy layer whose iron content is 40 to 80 atomic % is oxidized to form an oxide film thereon. This would come from the fact that the oxide film formed on the Fe—Sn alloy layer containing 40-80 atomic % of iron will contain both of iron and tin oxides, as shown in FIG. 1. The oxide film of the sample No. 6 would substantially comprise a single tin oxide and the oxide film of the sample No. 7 would, in turn, substantially comprise a single iron oxide, both of which show poor characteristics.

Although the steel sheet shown in FIG. 6 which comprises a steel substrate (a), a Fe—Sn alloy layer (b) formed thereon and containing 40-80 atomic % of iron, and an overlying oxide film (c) containing both iron and tin oxides will have substantially satisfactory characteristics, too much thickness of the oxide film (c) is disadvantageous because it functions to degrade lacquer adhesion and corrosion resistance and also tend to be separated from the underlying layers. For the purpose of eliminating these defects, according to this invention the followings are noted:

(1) The heating step after tin-plating should be performed in a reducing atmosphere, for example in a gas mixture consisting of 2-3% hydrogen and the reminder nitrogen.

(2) A limited thickness of the oxide film (c) would be formed on the Fe—Sn alloy layer (b), while after the heating step the steel sheet is subjected to a quenching treatment (usually air-quenching) and then being cooled in the air.

Figure 8:
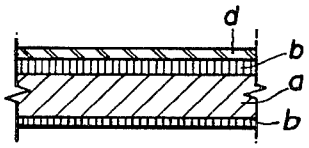

(3) The steel sheet thus produced is in most cases left being exposed to air for a substantial period, which will promote the growth of the oxide film (c). Then, the steel sheet having been quenched and cooled should then be subjected to a cathodic dichromate treatment so that a quantity of Cr is sufficiently diffused into the oxide film, thereby preventing further growth of the oxide film even in the air. With the cathodic dichromate treatment, the oxide film (c) once formed is converted to a composite oxide film (d) containing Fe, Sn, Cr and O, as shown in FIG. 7. If the case is allowed, the composite oxide film (d) may be formed on one side of the steel sheet as shown in FIG. 8.

The samples 3-5 of Table I which has been subjected to a cathodic dichromate treatment in accordance with this invention, show further improvement in lacquer adhesion and corrosion resistance, as shown in Table II. On the contrary, even when the cathodic dichromate treatment is applied in the same manner to a steel sheet having a single tin oxide (sample No. 6) or single iron oxide (sample No. 7), no improvement in lacquer adhesion and corrosion resistance can be established.

Since the composite oxide film (d) constitutes the outermost layer of the steel sheet according to this invention, it is important to control the conditions of the cathodic dichromate treatment so as to cause the resulting oxide film (d) to have satisfactory characteristics such as lacquer adhesion and corrosion resistance. In this connection the following example was practiced. More particularly, each sample of steel sheet comprising a steel base (a), a FeSn alloy layer (b) an an overlying oxide film (c) and containing 0.52 g/m$^2$ of tin all of which had been alloyed with iron of the steel base, was subjected to cathodic dichromate treatment under different conditions as follows:

(I) Sample Nos. 10–14 appeared to have a desired thickness of the oxide film (c) and therefore was subjected to a cathodic dichromate treatment immediately thereafter. The cathodic dichromate treatment was carried out in a bath consisting of 20 g/l of sodium dichromate, and the current density and treating time were varied as shown in the following Table III.

(II) Regarding sample No. 15, too large a thickness of the oxide film (c) was formed. This sample was at first cathodically treated in 30 g/l of a sodium hydrogen-carbonate solution at a current density of 8.1 A/dm$^2$ for 1 second so that the thickness of the oxide film was reduced, and then subjected to a cathodic dichromate treatment in 20 g/l of a sodium dichromate solution at a current density of 8.1 A/dm$^2$ for 1 second.

(III) Regarding sample No. 16, it appeared that the oxide film formed on the FeSn alloy layer was extremely thin and was not uniformly deposited thereon. Then, prior to the cathodic dichromate treatment, this sample was subjected to an anodic treatment so as to increase the thickness of the oxide film and make uniform the state thereof. More particularly, this sample was, in a bath consisting of 20 g/l of sodium dichromate and 40 g/l of boric acid, in the first step anodically treated at a current density of 2 A/dm$^2$ for 1 second and then in the second step cathodically treated at a current density of 8.1 A/dm$^2$ for 1 second.

With the treatment described above, the oxide film (c) of each sample was converted into a composite oxide film (d) containing Fe, Sn, Cr and O. The Fe quantity in the resulting composite oxide film (d) was measured in such manner that the composite oxide film was cathodically treated in a solution of 0.05M sodium tetraborate, at a pH=7.65 and a current density of 20 A/cm$^2$ so as to reduce the iron oxide, and the quantity of eluted iron was measured with ICP. Under the same cathodic condition, the quantity of electricity necessary for reducing the tin oxide in the composite oxide film was measured. Moreover, Cr quantity in the composite oxide film was measured by FX. The results of these measurements are shown in the following Table III.

Tests were made on the lacquer adhesion and corrosion resistance of the samples shown in Table III, the results of which are shown in the following Table IV.

TABLE III

| sample | quantity of tin (g/m$^2$) | atomic ratio Fe/Fe + Sn of alloy layer | treatment type | treatment current density | treatment treating time | composite oxide film Fe quantity (mg/m$^2$) | composite oxide film Cr quantity (mg/m$^2$) | composite oxide film electricity to Reduce Sn oxide (mcoul/dm$^2$) |
|---|---|---|---|---|---|---|---|---|
| 10 | 0.52 | 0.50 | I | 6.6 A/dm$^2$ | 1.0 sec | 2.1 | 7.2 | 91 |
| 11 | " | " | I | 4.2 | 2.0 | 0.9 | 8.3 | 40 |
| 12 | " | " | I | 4.8 | 0.5 | 5.2 | 2.1 | 232 |
| 13 | " | " | I | 9.2 | 1.0 | 1.3 | 10.9 | 62 |
| 14 | " | " | I | 4.0 | 0.5 | 4.5 | 1.8 | 203 |
| 15 | " | " | II | | | 1.9 | 7.1 | 61 |
| 16 | " | " | III | | | 3.4 | 3.6 | 121 |

TABLE IV

| sample | corrosion resistance without painting: room condition | corrosion resistance without painting: wet air condition | corrosion resistance after painting: cross cut | corrosion resistance after painting: Erichsen | lacquer adhesion |
|---|---|---|---|---|---|
| 10 | ◎ | ◎ | o | o | o |
| 11 | o | o | x | x | o |
| 12 | o | o | x | x | x |
| 13 | o | o | o | o | x |
| 14 | x | x | x | x | x |
| 15 | ◎ | ◎ | o | o | o |
| 16 | ◎ | ◎ | ◎ | ◎ | ◎ |

The method of tests and the references of judgement of Table IV are as follows:

(1) Corrosion resistance without painting

After maintaining the sample in a room for 1 month and in air having a relative humidity of 95%, at 50° C. for 24 hours, the manner of forming rust was measured. Symbol " ◎ " indicates that no rust could be confirmed with the naked eye, "o" scarecely confirmed and "x" the degree of rust formation is large.

(2) Corrosion resistance after painting

After plating with 5 g/m$^2$ of an epoxide phenol type lacquer, the sample was baked at a temperature of 205° C. for 10 minutes and was then scratched. The degree of corrosion of the cross-scratched portion was measured, after immersing in a citric acid solution for 96 hours, and after extruding by 2 mm with an Erichsen testing machine and then immersing in the same solution for 96 hours, respectively. Symbol " ◎ " represents no peel off, "o" a little peel off and "x" a large peel off.

(3) Lacquer adhesion

After plating in the same manner as in (2), T-peel test was made. More particularly, a pair of the plated sheets were placed one upon another, with the plated sides being thermally welded by means of a nylon film, then the sheets were peeled off at a rate of 20 cm/min. while sprinkling water, and the T-peel strength required for peeling off was measured after retort process of 127° C. for 30 minutes. A larger T-peel strength means a better lacquer adhesion. Symbol " ◎ " represents a very good lacquer adhesion, "o" good lacquer adhesion and "x" poor lacquer adhesion.

As can be noted from Tables III and IV, the sample Nos. 10, 15 and 16 whose composite oxide film (d) contains 1-5 mg/m$^2$ of iron and 2-10 mg/m$^2$ of chromium have excellent lacquer adhesion and corrosion resistance before and after painting. Briefly speaking, when the iron and/or chromium content in the composite oxide film is less than the above-prescribed lower limit there is a tendency to degrade the corrosion resistance after painting (sample Nos. 11 and 14), whereas when the iron and/or chromium content exceeds the above-prescribed upper limit the lacquer adhesion will be lowered (sample Nos. 12 and 13). Accordingly, it is necessary to control the conditions of the cathodic dichromate treatment so as to form a composite oxide film (d) containing 1-5 mg/m$^2$ of iron and 2-10 mg/m$^2$ of chromium. Although the chromium content in the composite oxide film (d) may be decreased as far as chromium is minutely and uniformly diffused in the oxide film, it would be practically necessary to contain at least 2 mg/m$^2$ of chromium. The ratio of iron content to chromium content in the composite oxide film (d) should preferably be 0.3 to 1.5. The cathodic dichromate treatment should preferably be carried out at a current density of 2-10 A/dm$^2$ and quantity of electricity of 2-8 coulomb/dm$^2$.

As many apparently widely different embodiments of this invention may be made without departing from the spirit and scope thereof, it is to be understood that the invention is not limited to the specific embodiments thereof except as defined in the appended claims.

What we claim is:

1. A method for manufacturing steel sheets for welded and coated cans comprising the steps of preparing a steel sheet substrate, depositing on said substrate 0.05-0.7 g/m$^2$ of tin, heating in a reducing atmosphere said substrate covered with the tin layer for a time and to a temperature sufficient to form a Fe—Sn alloy layer whose iron content is 40 to 80 atomic percentage, all of the tin of the tin layer having been alloyed with iron of said substrate to form said Fe—Sn alloy layer, quenching and cooling said substrate covered with said Fe—Sn alloy layer to form an oxide film containing both of iron and tin oxides on said Fe—Sn alloy layer, and subjecting the resulting sheet to a cathodic dichromate treatment thereby converting said oxide film to a composite oxide film containing Fe, Sn, Cr and O, the quantities of Fe and Cr in said composite oxide film being 1-5 mg/m$^2$ and 2-10 mg/m$^2$, respectively.

2. The method according to claim 1 wherein the heating step is carried out in a reducing atmosphere which is formed by a gas consisting of 2-3% hydrogen and the remainder nitrogen.

3. The method according to claim 1 wherein the cathodic dichromate treatment is carried out at a current density of 2-10 A/dm$^2$ and quantity of electricity of 2-8 coulomb/dm$^2$.

4. The method according to claim 1 wherein the ratio of iron content to chromium content in said composite oxide film is 0.3 to 1.5.

5. The method according to claim 1 which further comprises the step of subjecting the sheet to an anodic dichromate treatment to increase the thickness of said oxide film before the cathodic dichromate treatment.

6. The method according to claim 1 wherein the heating step is carried out in a reducing atmosphere which is formed by a gas consisting of 2-3% hydrogen and the remainder nitrogen;

wherein the cathodic dichromate treatment is carried out at a current density of 2-10 A/dm$^2$ and quantity of electricity of 2-8 coulomb/dm$^2$; and wherein the ratio of iron content to chromium content in said composite oxide film is 0.3 to 1.5.

7. The method according to claim 6 which further comprises the step of subjecting the sheet to an anodic dichromate treatment to increase the thickness of said oxide film before the cathodic dichromate treatment.

* * * * *